US006033114A

United States Patent [19]

Grimm et al.

[11] Patent Number: 6,033,114

[45] Date of Patent: Mar. 7, 2000

[54] WINDOW BAG WITH POLYESTER LINING AND METHOD OF FORMING SAME

[75] Inventors: Charles T. Grimm, Orland Park; James Allen, Alsip; Nancy Chico, Worth; Gino Narduli, Norridge; Karen Susan Teter, Woodridge; Timothy J. Hannon, Clarendon Hills; Donald E. Wolski, Tinley Park; Harley Dubeck, Downers Grove; Ernest R. Herzog, Westchester, all of Ill.; Thomas William DePretoro, Pompano Beach, Fla.

[73] Assignee: Bagcraft Packaging, L.L.C., Chicago, Ill.

[21] Appl. No.: 09/009,699

[22] Filed: Jan. 20, 1998

[51] Int. Cl.[7] ..... B65D 33/04

[52] U.S. Cl. ..... 383/106; 383/100; 383/102; 383/113; 383/114; 383/116; 383/120

[58] Field of Search ..... 383/106, 109, 383/111, 113, 114, 116, 119, 120, 100, 102

[56] References Cited

U.S. PATENT DOCUMENTS

| | | | |
|---|---|---|---|
| 1,868,069 | 7/1932 | Munson | 383/106 |
| 2,128,374 | 8/1938 | Midulla . | |
| 2,158,755 | 5/1939 | Hodgon et al. | 383/106 X |
| 2,189,174 | 2/1940 | Hohl | 383/106 X |
| 2,297,375 | 9/1942 | Vogt | 383/106 X |
| 2,306,335 | 12/1942 | Feigenbutz . | |
| 2,316,385 | 4/1943 | Abramson . | |
| 2,752,085 | 6/1956 | Bryce | 383/106 |
| 3,235,168 | 2/1966 | Nichols | 383/106 X |
| 3,480,179 | 11/1969 | Rowland . | |
| 3,647,134 | 3/1972 | Carnevalino . | |
| 4,097,236 | 6/1978 | Daly et al. | 383/106 X |
| 4,265,949 | 5/1981 | Kugimiya | 383/106 |
| 4,341,825 | 7/1982 | Kemski | 383/106 X |
| 4,816,445 | 3/1989 | Mitsuhashi et al. . | |
| 4,866,786 | 9/1989 | Nagler . | |
| 4,982,064 | 1/1991 | Hartman et al. . | |
| 5,059,436 | 10/1991 | Clark . | |
| 5,061,500 | 10/1991 | Mendenhall . | |
| 5,199,792 | 4/1993 | Roosa . | |
| 5,335,996 | 8/1994 | Cortopassi et al. . | |
| 5,507,579 | 4/1996 | Sorenson . | |
| 5,560,945 | 10/1996 | Geddes et al. . | |

FOREIGN PATENT DOCUMENTS

| | | |
|---|---|---|
| 2 156 303 | 10/1985 | United Kingdom . |

OTHER PUBLICATIONS

Bagcraft Corporation of America product literature entitled Bagcraft Has The Right Packaging For Your Products, Mar. 15, 1994.

Bagcraft Corporation of America product literature entitled Bagcraft Has The Right Packaging For Your Products, copyright 1994.

Bagcraft Corporation of America product literature dated Oct. 30, 1992; Mar. 1, 1993; Aug. 1, 1993; Nov. 1, 1994; Aug. 1996; Aug. 15, 1996; Sep. 1, 1996; Jan. 1, 1997; Jun. 1, 1997.

*Primary Examiner*—Jes F. Pascua

*Attorney, Agent, or Firm*—Fitch, Even, Tabin & Flannery

[57] ABSTRACT

An ovenable bag for packaging heated, greasy food items for display is formed of a laminate having a thin, transparent, polyester inner layer and a relatively thicker and stiffer opaque outer layer formed of a foldable and printable material. The wall structure is generally tubular and is folded to define front and rear panels and gusseted side panels, one end of the structure being folded, heat sealed and then folded again and adhesively secured. The window portion extends the length of the front panel of the bag centrally thereof. The outer layer is bonded to the inner layer along the entire area of the outer layer except for an optional tear strip which may be disposed along one edge of the window. The bag may also be heat sealed along the fold lines joining the side panels to the front and rear panels for added stiffness.

19 Claims, 2 Drawing Sheets

Fig. 1
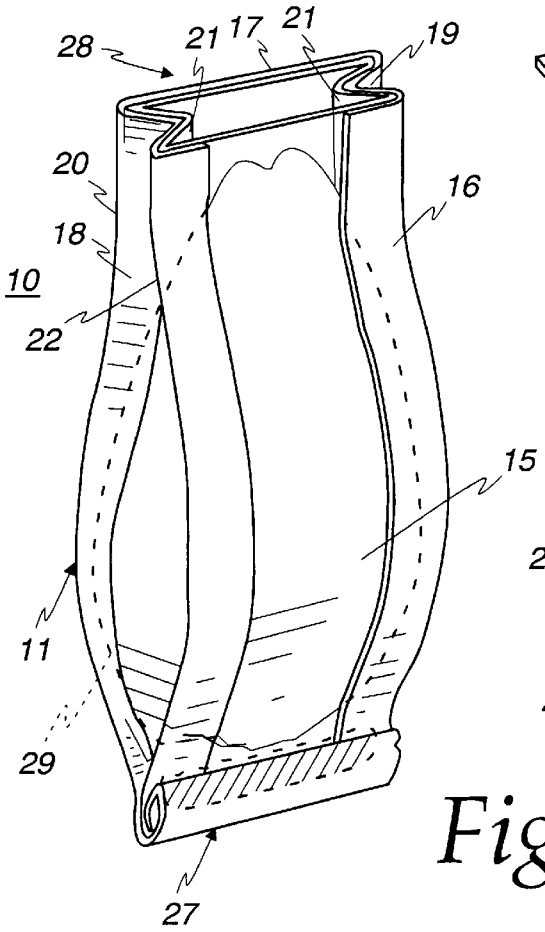
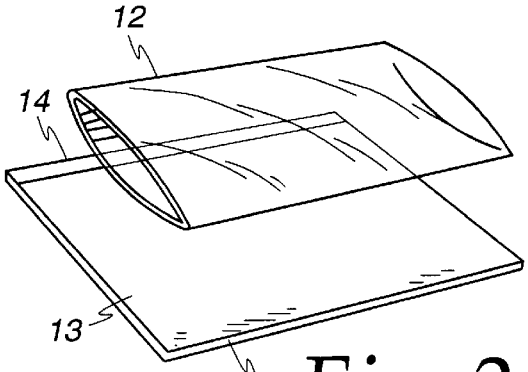
Fig. 2
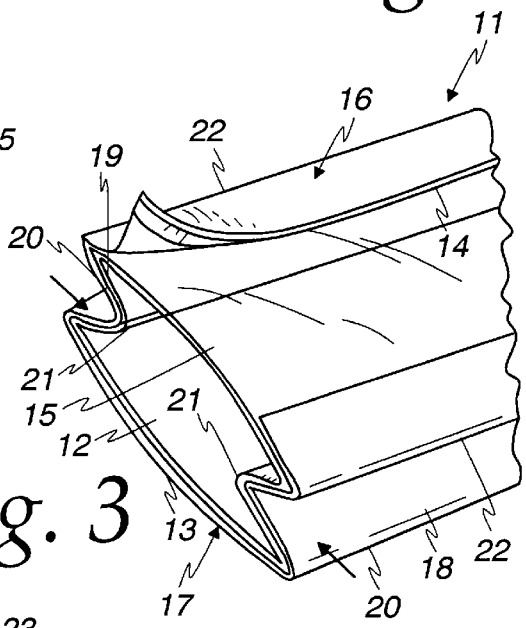
Fig. 3
Fig. 4
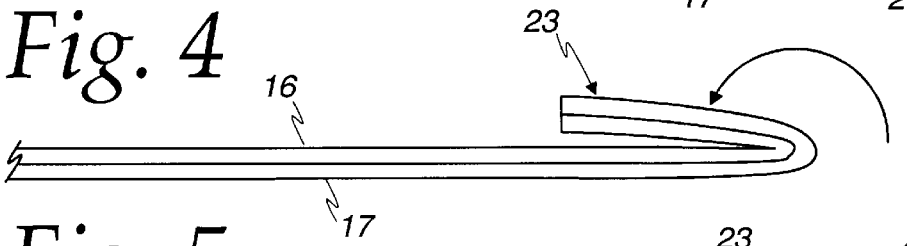
Fig. 5
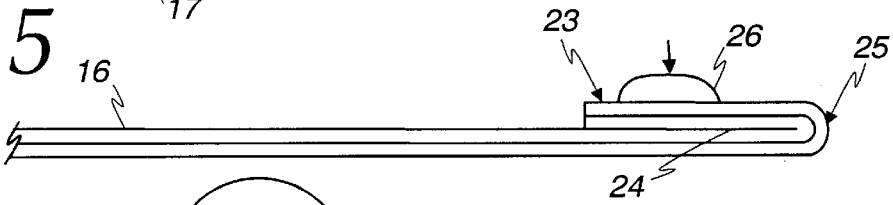
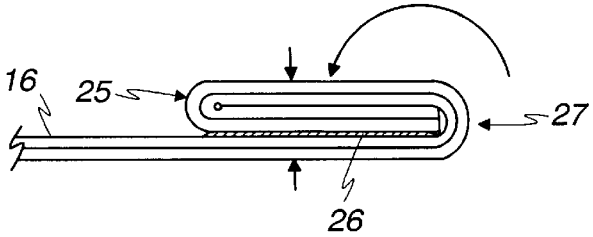
Fig. 6

WINDOW BAG WITH POLYESTER LINING AND METHOD OF FORMING SAME

BACKGROUND OF THE INVENTION

1. Field of the Invention

The present invention relates generally to food bags and, more specifically, bags of the type used in the food industry to facilitate the display and carry-out of hot food items.

2. Description of the Prior Art

In the carry-out food industry, the container in which food items are presented and delivered to the customers is very important. In this regard, a number of different types of containers have been utilized for display and/or carry-out of a variety of different types of food items. Where it is desirable that the food item be packaged for display at the point of sale, transparent bags, formed of suitable plastic sheet or film material, have been utilized. While such bags offer a clear view of the food item enclosed therein, they are not suitable for many types of food items, particularly hot and/or moist or greasy food items. Furthermore, they may provide too complete a view of the food item, including unsightly portions, such as grease drippings, crumbs and the like, which the vendor might prefer to conceal to enhance the appearance of the product. Furthermore, they are not easily printable and lack stiffness.

It is known to provide window bags which comprise essentially an opaque bag material formed of paper or the like with a transparent "window" formed therein and defined by a transparent plastic sheet or film, so as to display part, but not all of the packaged food item. However, in such bags, the "window" is typically formed of a plastic film material, such as polypropylene, polyethylene or acetate, which tends to fog in the presence of hot, moist foods, impairing visibility. Furthermore, such window bags are either essentially single-ply, being formed of a single thickness of paper (except for the window which is formed of a single thickness of plastic film) so that the bag is not suitable for many types of moist products, and/or the bag is a stand-up type with a flat bottom, which tends to leak when used to package moist food products with grease, juices or the like.

Window bags have also been provided with the window being formed of a breathable plastic material, such as polyester but, again, such bags have not been used with moist or juicy food items because of the tendency to leak.

It is also known to package hot, greasy foods for display in plastic "dome" containers, which are two-part containers including a bottom or tray, which may be formed of either transparent or opaque plastic, and a transparent plastic cover or "dome." While such containers can effectively contain hot and greasy foods without leaking, they are relatively expensive, are not breathable and, therefore, tend to fog easily. Also, moisture tends to accumulate on the inner surface of the dome and then tends to drip back onto the food items. Furthermore, such containers occupy considerable space. Finally, they suffer a disadvantage of completely transparent bags, in that they may sometimes show too much of the enclosed food item.

SUMMARY OF THE INVENTION

It is a general object of the invention to provide an improved bag for packaging heated, moist or juicy food items for display through a window portion of the bag, wherein the bag avoids the disadvantages of prior containers while affording additional structural and operating advantages.

An important feature of the invention is the provision of a display bag of the type set forth, which is moisture-proof and leak-resistant.

In connection with the foregoing feature, a further feature of the invention is the provision of a bag of the type set forth, which affords thermal insulation for retaining the heat in heated food items.

In connection with the foregoing features, a further feature of the invention is the provision of a bag of the type set forth, which is ovenable and microwaveable and which is formed of a material which is heat sealable and resists fogging.

Still another feature of the invention is the provision of a bag of the type set forth, which is sturdy and easily printable.

Yet another feature of the invention is the provision of a bag of the type set forth which is foldable and stain resistant.

A still further feature of the invention is the provision of a bag of the type set forth which affords adequate stiffness so as to retain its expanded shape in use.

Certain ones of these and other features of the invention may be attained by providing an ovenable bag for packaging heated, moist food items for display, the bag comprising: a laminate defining an elongated, generally tubular wall structure having opposed ends, the laminate including a thin transparent inner layer formed of a heat-sealable, moisture-proof and anti-fogging material, and a relatively thicker and stiffer opaque outer layer formed of a foldable and printable material fixedly secured to the inner layer and covering the inner layer except along a window portion of the inner layer extending end-to-end of the wall structure, the wall structure being flattened, folded and heat-sealed at one end thereof for closing the one end.

Further features of the invention may be attained by providing a bag of the type set forth which is provided with a removable tear strip for promotional or advertising purposes.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of a bag constructed in accordance with and embodying the features of a first embodiment of the present invention;

FIG. 2 is a reduced, exploded, perspective view of the two layers of the bag of FIG. 1 before lamination thereof;

FIG. 3 is an enlarged, fragmentary, perspective view of the open end of the bag of FIG. 1 with a portion of the outer layer peeled back to illustrate the lamination;

FIG. 4 is a fragmentary, side elevational view of the bag of FIG. 3, illustrating the first folding step in forming the heat-sealed bottom;

FIG. 5 is a view similar to FIG. 4, illustrating another step in the formation of the sealed bottom;

FIG. 6 is a view similar to FIG. 5 showing a final step in the bottom-formation process;

DESCRIPTION OF THE PREFERRED EMBODIMENTS

Figure 7:
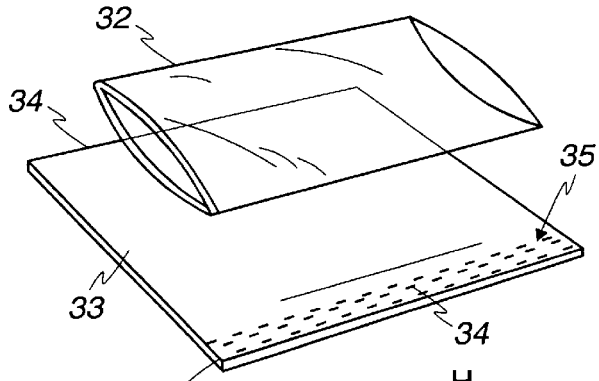
FIG. 7 is a view similar to FIG. 2, illustrating another embodiment of the invention.

Referring to FIG. 1, there is illustrated a bag 10, constructed in accordance with a first embodiment of the present invention. Referring also to FIGS. 2 and 3, the bag 10 includes a generally tubular wall structure 11 of laminated construction including an inner layer 12 of transparent material and an outer layer 13 of substantially opaque material. In a preferred embodiment of the invention, the inner layer 12 is formed of a plastic sheet or film which is ovenable, microwaveable and freezable, affords moisture, oil and aroma barriers, is heat-sealable and is breathable so as to be anti-fogging. A preferred material is a polyester material of the type which is commercially available as "MYLAR"®. The outer layer 13 is formed of a suitable, relatively stiff, foldable and easily printable material, such as kraft paper, although it could also be formed of other materials, such as metal foils and the like in non-microwaveable applications. The outer layer 13 may be suitably treated so as to be stain-resistant.

In forming the bag 10, the inner layer 12 is formed as a complete tube and cut to a predetermined length and then the outer layer 13 is wrapped around the inner layer 12 and fixed thereto, as by a suitable adhesive. In this regard, the width of the outer layer 13 is less than the circumference of the inner layer 12, so that when the parts are laminated together the side edges 14 of the outer layer 13 are spaced apart to define the borders of an uncovered portion or window 15 in the inner layer 12.

After lamination, the wall structure 11 is folded and flattened to define a front panel 16 and a rear panel 17 joined by gusseted side panels 18 and 19, in a known manner. More particularly, each of the side panels 18 and 19 is generally V-shaped in transverse cross section and is formed by three longitudinally-extending fold lines 20, 21 and 22, so that each side panel is joined to the rear panel 17 at the fold line 20 and is joined to the front panel 16 at the fold line 22. The folds are arranged so that the window 15 is positioned centrally of the front panel 16, the width of the window 15 being such that it is spaced a predetermined distance from each of the side panels 18 and 19.

Referring now also to FIGS. 4–6, one end of the wall structure 11 is then sealed. More particularly, an end margin 23 of the laminate is folded forward along the front panel 16, as in FIG. 4, and the folded material is then heat sealed, as at 24 in FIG. 5 to form a heat-sealed end 25. Then a layer of adhesive 26 is applied to the exposed surface of the folded margin 23. The heat-sealed folded end 25 is again folded forward along the front panel 16, at the distal end of the margin 23, being adhesively secured to the front panel 16 by application of appropriate sealing pressure in the direction of the arrows in FIG. 6. There results a heat-sealed and adhesively-sealed closed end 27 of the bag 10, which is substantially leak proof. The other end 28 of the wall structure 11 remains open to provide an entry into the bag 10 for insertion therein of a food item 29, such as a rotisserie chicken, or other moist food item or items.

There results a bag 10 which is ovenable, microwaveable and freezable, is essentially leak-proof and stain resistant, provides moisture, oil and aroma barriers, is heat-sealable and provides a breathable window 15 which is essentially anti-fogging. The kraft paper outer layer 13 affords stiffness, foldability and printability and may be treated to be stain-resistant. The gussetted side walls 18 and 19 assist in having the finished bag 10 maintain its expanded shape. The combination of the kraft paper outer layer and the polyester inner layer also affords thermal insulation to maintain the heat in heated food products disposed in the bag 10.

Figure 8:
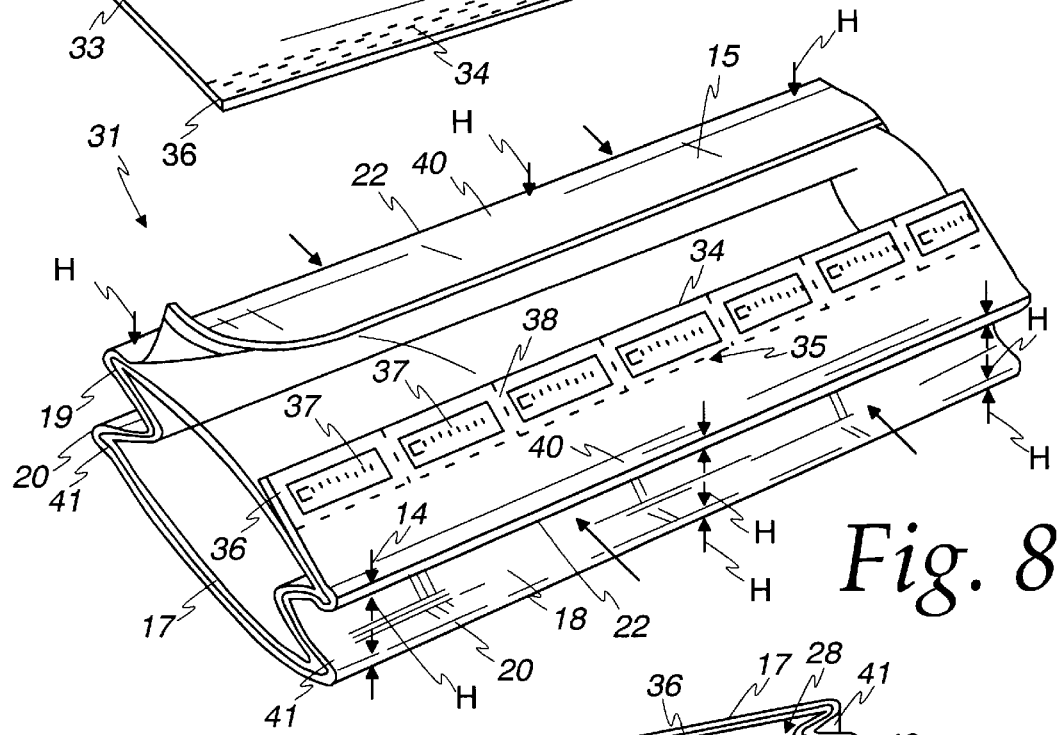
FIG. 8 is a view similar to FIG. 3, illustrating the bag of FIG. 7.
Figure 9:
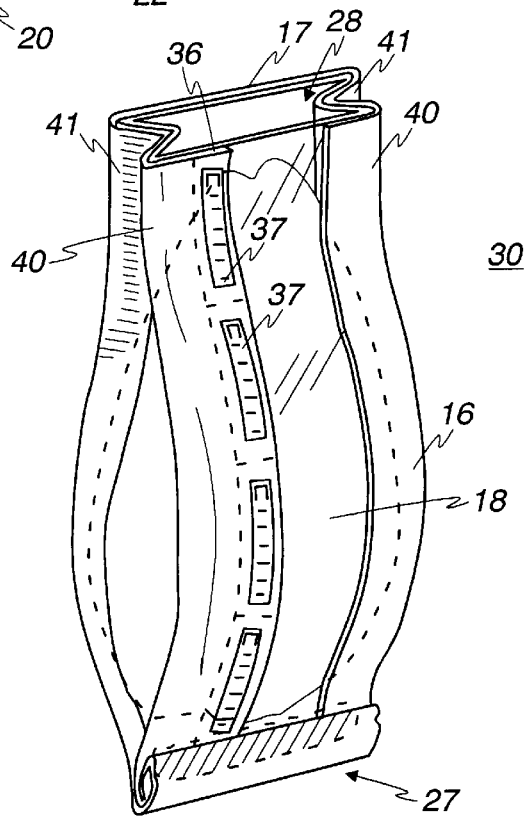
FIG. 9 is a view similar to FIG. 1, illustrating the finished bag of the embodiment of FIG. 7.

Referring now to FIGS. 7–9, there is illustrated another bag 30 constructed in accordance with another embodiment of the invention. The bag 30 is similar to the bag 10, described above, and like parts have the same reference numerals. The bag 30 has a laminated wall structure 31 including an inner layer 32 and an outer layer 33, the material, formation and lamination of which are substantially the same as was described above for the bag 10, with the exception that the outer layer 33 has a greater width so that, when the outer layer 33 is applied around the inner layer 32 its lateral side edges 34 are closer together, defining a narrower window. A side margin of the outer layer 33 defines a tear strip 36 which is joined to the remainder of the outer layer 33 along a longitudinally-extending row of perforations 35. The tear strip 36 is not secured to the inner layer 32, defining a free strip which can easily be torn from the bag 10 along the perforation line 35. The tear strip 36 may bear indicia 37 for advertising, promotional or other purposes. These indicia may be repetitive and in the form of coupons, or the like, which may be separated from one another by laterally extending perforation lines 38.

The folding and the heat sealing of the ends of the bag 30 are substantially the same as was described above for the bag 10, except that there is an additional heat-sealing step. More particularly, referring to FIG. 8, the outer marginal portions of each of the side panels 18 and 19 is heat sealed to adjacent portions of the front and rear panels 16, 17 adjacent to the fold lines 20 and 22, as indicated by the arrows H, to form heat-sealed margins 40 and 41. This additional heat sealing provides added stiffness to the finished bag 30 and further assists in having the bag maintain its expanded shape.

In all other respects, the bag 30 functions in the same manner as was described above in connection with the bag 10. Indeed, it will be appreciated that the heat sealing of the side panel margins could also be utilized in the bag 10 of FIGS. 1–6.

In a constructional model of the invention, the inner layers 12 and 32 are formed of polyester film having a thickness of from 1 to 2 mils., while the outer layers 13 and 33 are formed of 30-lb. to 70-lb. basis weight kraft paper. However, it will be appreciated that other outer layer materials, including foils, vegetable parchment and special grades or treatments of paper could also be utilized. The polyester inner layer material affords an excellent heat seal material for heat sealing the bottoms of the bags 10 and 30 and the side panel margins of the bag 30. Typically, the open ends 28 of the bags 10 and 30 may simply be folded over and secured by any desired means. Alternatively, these ends could also be heat sealed after the food items are loaded into the bag. The stiffness of the finished bag helps keep the printed bag sides raised up away from the surface of the enclosed food product, which helps to keep the window clean, clear and appetizing. The polyester-lined bags can be reheated at home and in ovens and leftovers can be stored in a bag in a freezer for later consumption.

While, in the illustrated embodiments, the outer layer 13 or 33 is formed of a single layer of paper, it could be formed of a laminated material. The merchandising tear strip 36 of the bag 30 can easily be removed for instant use without damaging the bag or in any way impairing its usefulness.

From the foregoing, it can be seen that there has been provided an improved bag for packaging food items, which affords ready visibility of the contents of the bag, while at the same time is easily printable, affords improved stiffness, has an anti-fogging viewing window, is essentially leak-proof and provides effective moisture, oil and aroma barriers.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An ovenable bag for packaging heated, moist food items for display, said bag comprising:

a laminate defining a elongated, generally tubular wall structure having opposed ends, said laminate including a thin transparent inner layer formed of a heat-sealable, moisture-proof and anti-fogging material, and a relatively thicker and stiffer opaque outer layer formed of a foldable and printable material fixedly secured to said inner layer and covering said inner layer except along a window portion of said inner layer extending end-to-end of said wall structure, said window portion having uncovered and breathable surfaces sized to permit the migration of heated moisture from the interior of bag to the exterior of the bag in amounts which prevent substantial fogging of the window portion, said wall structure being flattened, folded and heat-sealed at one end thereof for closing said one end.

2. The bag of claim 1, wherein said inner layer is formed of polyester.

3. The bag of claim 1, wherein said outer layer is formed of kraft paper.

4. The bag of claim 1, wherein said folded and heat-sealed end of said wall structure is folded over and adhesively secured to an adjacent portion of the wall structure.

5. The bag of claim 1, wherein said window portion is substantially rectangular in shape.

6. The bag of claim 5, wherein said bag includes front and rear panels joined by side panels, said window portion being disposed in said front panel centrally thereof and spaced from said side panels.

7. The bag of claim 6, wherein each of said side panels is gusseted.

8. The bag of claim 1, wherein said inner and outer layers are bonded together over substantially the entire area of said outer layer.

9. An ovenable bag for packaging heated, moist food items for display, said bag comprising:

a laminate defining a elongated generally tubular wall structure having opposed ends, said laminate including a thin transparent inner layer formed of a heat-sealable, moisture-proof and anti-fogging material, and a relatively thicker and stiffer opaque outer layer formed of a foldable and printable material fixedly secured to said inner layer and covering said inner layer except along a window portion of said inner layer extending end-to-end of said wall structure, said outer layer includes an elongated strip disposed along a longitudinal edge of said window portion, said outer layer being bonded to said inner layer along substantially the entire area of said outer layer except for said strip, said wall structure being flattened, folded and heat-sealed at one end thereof for closing said one end.

10. The bag of claim 9, wherein said strip is joined to the remainder of said outer layer by a line of perforations to facilitate tearing of said strip from said wall structure.

11. An ovenable bag for packaging heated, moist food items for display, said bag comprising:

a laminate defining an elongated, generally tubular wall structure having opposed ends, said wall structure being folded to define front and rear panels joined by gusseted side panels so that each of said side panels is joined to said front and rear panels, respectively, at longitudinal fold lines, said laminate including a thin transparent inner layer formed of a heat-sealable, moisture-proof and anti-fogging material, and a relatively thicker and stiffer opaque outer layer formed of a foldable and printable material fixedly secured to said inner layer and covering said inner layer except along a window portion of said inner layer extending end-to-end of said wall structure, said wall structure being flattened, folded and heat-sealed at one end thereof for closing said one end, said laminate being heat sealed along the entire length of each of said longitudinal fold lines.

12. The bag of claim 11, wherein said inner layer is formed of polyester.

13. The bag of claim 11, wherein said outer layer is formed of kraft paper.

14. The bag of claim 11, wherein said folded and heat-sealed end of said wall structure is folded over and adhesively secured to an adjacent portion of the wall structure.

15. The bag of claim 11, wherein said window portion is substantially rectangular in shape.

16. The bag of claim 15, wherein said bag includes front and rear panels joined by side panels, said window portion being disposed in said front panel centrally thereof and spaced from said side panels.

17. The bag of claim 11, wherein said inner and outer layers are bonded together over substantially the entire area of said outer layer.

18. The bag of claim 11, wherein said outer layer includes an elongated strip disposed along a longitudinal edge of said window portion, said outer layer being bonded to said inner layer along substantially the entire area of said outer layer except for said strip.

19. The bag of claim 18, wherein said strip is joined to the remainder of said outer layer by a line of perforations to facilitate tearing of said strip from said wall structure.

* * * * *